United States Patent [19]

Hucke

[11] 4,129,178

[45] Dec. 12, 1978

[54] HEAT EXCHANGE INSTALLATION FOR HEATING AND COOLING A LIQUID HEAT CARRIER MEDIUM

[76] Inventor: Hans Hucke, Essigweg 6, CH-4133, Pratteln-Basel, Switzerland

[21] Appl. No.: 706,841

[22] Filed: Jul. 19, 1976

[30] Foreign Application Priority Data

Jul. 23, 1975 [DE] Fed. Rep. of Germany ..... 2532978

[51] Int. Cl.[2] ..... F25B 29/00; F28D 15/00; H05B 3/82; B67D 5/62

[52] U.S. Cl. ..... 165/61; 165/50; 165/107 R; 165/132; 219/297; 219/299; 219/306; 219/314; 219/341; 222/146 R; 222/146 C

[58] Field of Search ..... 219/296–309, 219/310, 312, 314, 280, 281, 421, 341; 222/146 HE, 146 R, 146 H; 165/50, 107, 132, 58, 61, 65

[56] References Cited

U.S. PATENT DOCUMENTS

| | | | |
|---|---|---|---|
| 1,905,439 | 4/1933 | Carleton | 219/307 |
| 1,965,218 | 7/1934 | Carr | 219/306 |
| 1,983,043 | 12/1934 | Martin | 219/306 |
| 2,041,071 | 5/1936 | Keegam et al. | 219/312 X |
| 2,181,953 | 12/1939 | Usselman | 165/107 X |
| 2,641,451 | 6/1953 | Kaiser | 165/132 X |
| 2,690,327 | 9/1954 | Sardeson | 165/107 X |
| 2,711,473 | 6/1955 | Mahaffey et al. | 165/107 X |
| 2,779,855 | 1/1957 | Sawyer | 219/297 |
| 2,994,514 | 8/1961 | Brown | 165/107 X |
| 3,606,095 | 9/1971 | Kronseder | 222/146 HE |

*Primary Examiner*—A. Bartis

*Attorney, Agent, or Firm*—Haseltine, Lake, & Waters

[57] ABSTRACT

A heat transfer arrangement operable selectively for heating, cooling and tempering in which a heating and cooling system, and a pump are applied under predetermined flow conditions, whereby directed and substantially constant speed prevails over the entire cross-section of the flow path. The heating system with the pump and also the cooling system are located in a common tank which serves simultaneously as a collector tank for the heat carrier medium and an expansion tank of the arrangement. The heating system has several straight tube sections, running parallel to one another for an extended length, to transport the heat carrier medium. The heating system is provided with electrical heating elements in the form of rods which are inserted in the parallel straight tube sections, and leave a free flow-through cross-section. The cooling system, on the other hand, is provided with tubular cooling jackets which surround the parallel straight tube sections, leaving a free flow-through cross-section to conduct the cooling medium.

5 Claims, 1 Drawing Figure

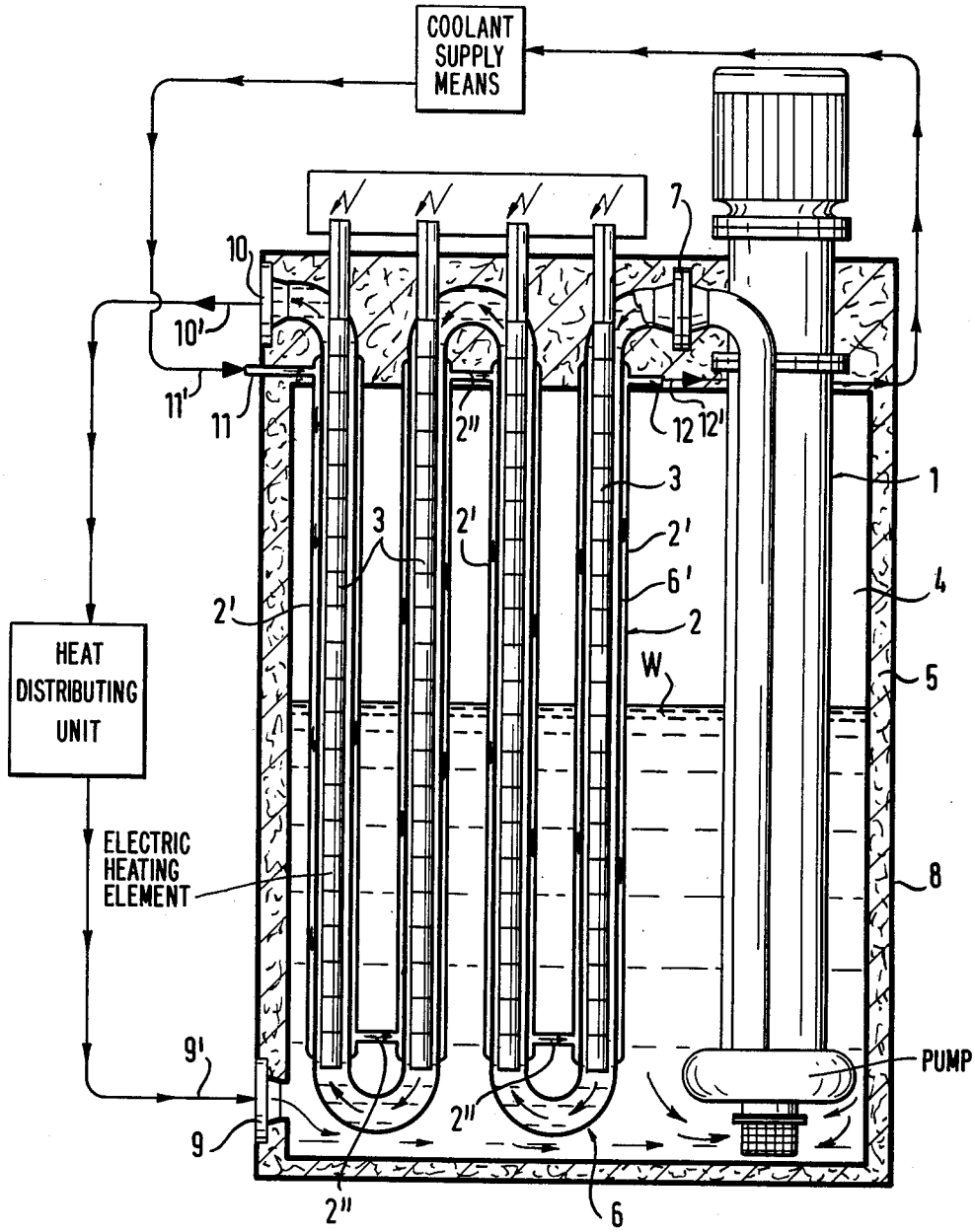
COOLANT SUPPLY MEANS
HEAT DISTRIBUTING UNIT
ELECTRIC HEATING ELEMENT
PUMP
1
2
2'
2''
3
4
5
6
6'
7
8
9
9'
10
10'
11
11'
12
12'
W

HEAT EXCHANGE INSTALLATION FOR HEATING AND COOLING A LIQUID HEAT CARRIER MEDIUM

BACKGROUND OF THE INVENTION

This invention relates to a heat exchange installation.

In heat exchange installations there are provided a heating system, a pump, more particularly a circulating pump, for the forced conveyance of a heat-carrying medium, for example oil, or other pumpable substance, under defined conditions of flow. An expansion vessel and a storage vessel for the heat-carrying medium or the other pumpable substance are also provided. When the heat-carrying media and any other pumpable substances are temperature-controlled and maintained in circulation under predetermined conditions of flow or otherwise further conveyed, it is necessary, for example in the case of heating installations, for a heat-consuming unit to be maintained at a predetermined temperature by means of the heat-carrying medium. For safety reasons, a film temperature increase at the tube wall must be maintained within closely defined limits in order to avoid thermal decomposition of the heat carrier. This is made possible by a forced circulation of the heat carrier under defined conditions of flow.

Heat exchange installations are known, in which the heat transmission is effected by:

(a) free convection (natural circulation, thermosyphon);

(b) natural convection; and (c) forced convection.

While substantially only water is used as the heat-carrying medium in heating installations according to (a) and (b), various heat-carrying media may be employed in heating installations according to c). More particularly, such installations are suitable for the use of oil as the heat-carrying medium, because the danger of thermal decomposition of the oil is low.

Two types of such installations are known.

One type is an "immersion heater" system, in which the heat-carrying medium is heated in a storage container by means of electrical heating elements and is maintained in circulation by a circulating pump. In this case, the disadvantage exists that, owing to the lack of a defined or regulated flow in the heating system, an uncontrolled thermal loading of the heat-carrying medium may occur, which may result in thermal decomposition and hence cause fire and safety problems when oil is employed as the heat-carrying medium. (In Germany, for example, it is no longer permitted to install new heat exchange systems of this kind for the use of oil as heat carrier.) On the other hand, however, sealing to prevent leakages of heat carrier can be more readily carried out in such immersion heater systems.

The second kind of heat exchange installation comprises a forced-circulation heater. In this case, the heat-carrying medium is maintained in forced circulation under defined or regulated conditions of flow. With simultaneous heating of the heat carrier, a known heat flux density is ensured, so that there are substantially no difficulties with regard to the possible thermal decomposition of the heat-carrying medium, for example heat-carrying oil, in contrast to the case in the immersion heater system. On the other hand, in heating installations or apparatus having forced flow which are known to me, in Germany, a large number of connecting flanges with sealing points is necessary, so that there is a large number of possible leakage points. For this reason, inter alia, such forced-circulation installations involve higher cost of labour and equipment than immersion heater systems.

OBJECT OF THE INVENTION

An object of the present invention is to provide a heat exchange installation which requires considerably fewer connecting flanges and seals and can readily be constructed so that the possible occurrence of leaks is substantially avoided.

SUMMARY OF THE INVENTION

According to the present invention there is provided a heat exchange installation comprising:

(a) a vessel for the storage of a substance therein, which vessel is provided with an inlet for the substance;

(b) a pump located within the vessel, which pump is provided with an inlet, communicating with the interior of the vessel, and an outlet;

(c) a conduit for the forced conveyance of the substance therethrough, which conduit extends for at least a part of its length through the vessel and is provided with an inlet, which communicates with the outlet of the pump, and an outlet which is located externally of the vessel; and (d) means for adjusting the temperature of the substance as it is passed through the conduit by means of the pump.

Thus, the heat exchange system is disposed together with the pump in a common vessel which forms at the same time the storage vessel for the heat-carrying medium or the other pumpable substance and the expansion vessel of the installation.

A heat exchange installation constructed in accordance with the invention has the advantage that, in contrast to known installations of this kind, separate or special pressure vessels, such as an expansion vessel and a storage vessel for the substance, and the associated connections with their connecting flanges and sealing means, are avoided, because the two vessels are combined to form a single vessel while at the same time meeting the safety requirements currently in force in Germany. The said combined vessel receives a large part of the substance, as in an "immersion heater" system. Also, no special pressure container for the temperature adjusting means is required, and the common vessel may with advantage by used at the same time as a degassing vessel.

The temperature-adjusting means may comprise an electrical heating element located in the conduit and/or a jacket located around the conduit for the passage of a temperature-adjusting fluid around the conduit.

In a particularly convenient embodiment of the invention, in the case of the construction as a combined heating and cooling apparatus with an additional cooling system, the cooling system, the cooling system is also disposed in the common vessel. In this way, there is provided a combined heating and cooling installation which is of simple construction and which has forced circulation of the substance under defined conditions of flow, but which also has the aforesaid advantages over the known installations of this kind. In addition, no separate coolant container is necessary in the installation according to the invention, but if the heating system comprises for the passage of the substance therein a coiled tube, more particularly one having a number of straight tube sections extending parallel to one another over a considerable length, the cooling system may comprise for the passage of a coolant tubular cooling jackets which surround the straight tube sections. The cooler which has hitherto usually been employed for the dissipation of exothermic heat is in this case replaced by tubes involving little expenditure.

In addition, in the installation according to the invention, the component parts which are disposed in the common vessel, i.e. the heating system and the circulating pump, and where necessary the cooling system, may be introduced into the common vessel as a pre-assembled unit with only one connecting point formed by connecting flanges between the pump or circulating pump and the heating system. In this case, the further advantage is obtained that substantial component parts of the heat transmission installation according to the invention are in transportable form and may be immersed in media whose temperature is to be controlled, for example in order to form only a heating installation or a heating and cooling installation having forced circulation and defined or regulated flow conditions. More particularly, such a transportable unit may be introduced into the collecting vessel, serving to receive the substance, of an existing, obsolete "immersion heater" system in order to adapt the latter to the most recent German safety requirements, using the existing vessel as the common vessel. In this case, however, the substantial disadvantage of an "immersion heater" system, i.e. the danger of thermal decomposition of the substance, e.g. an oil, due to undefined flow conditions is avoided, on the one hand, while on the other hand in this and all other embodiments of the invention a substantial simplification in the construction of the installation is achieved, in that inter alia even in the construction of the installation as a combined heating and cooling installation the flange connections are reduced to two flanges.

By the provision of further temperature-control jackets in the region of the heater, the installation according to the invention may be varied to form a heat exchanger having forced circulation under defined conditions of flow, either only in the heating region or only in the cooling region, or in both regions. In addition, if tubular cooling jackets surrounding the straight tube sections of the heater system are provided, a further advantage resides in the possibility of temperature control afforded not only by way of the electrical heating elements, which may be provided in preferably rod-like form in the straight tube sections of the heating system, but also by the introduction of, for example, steam into the cooling jackets. In this way, the substance situated in the common vessel may be subjected to an initial temperature adjustment and in flowing through the tube sections of the heating system it may be brought to a higher temperature in a second stage by means of the electrical heating elements. Likewise, there exists the advantage that intense cooling may be effected by the introduction of coolant through the cooling chambers.

BRIEF DESCRIPTION OF THE DRAWINGS

For a better understanding of the present invention and to show more clearly how the same may be carried into effect, reference will now be made, by way of example, to the accompanying diagrammatic drawing the sole view of which is a vertical cross-section through one embodiment of a heat exchange installation according to the present invention.

DESCRIPTION OF THE PREFERRED EMBODIMENTS

In the illustrated embodiment, the heat exchange installation according to the invention is enclosed in a cabinet-like housing 8 ready for connection to a heat consuming (or distributing) unit. The housing 8 is completely closed and is provided internally with insulation 5. The installation itself is constructed as a combined heating and cooling installation having forced circulation of a heat-carrying medium W, which is preferably oil, under defined conditions of flow. For this purpose, the installation comprises a circulating pump 1, a heating system and a cooling system.

In contrast to known installations, in the installation according to the present invention the circulating pump 1 is disposed in a common vessel 4 which at the same time forms an expansion vessel and a storage container (or storage vessel) for the heat-carrying medium W and which is provided with an inlet duct 9 for the heat-carrying medium. A heating system comprises a tube 6, which may be coiled or otherwise bent and which is connected to the circulating pump 1. The tube 6 is provided with anumber of straight tube sections 6' which extend parallel with one another, the respective lengths of the sections 6' corresponding substantially to the height of the common vessel 4. Like the circulating pump 1, the tube 6 extends at its lower end into the heat-carrying medium W as in an "immersion heater" system. The tube 6 is connected to the circulating pump 1 by a single flange connection 7. In the illustrated embodiment, electrical heating elements 3 in the form of rods are introduced from above into the straight tube sections 6' in such a manner as to leave a free cross-sectional area of throughflow for the circulation of the heat-carrying medium W. That end of the tube 6 which is further from the circulating pump 1 is provided with an outlet duct 10 which, like the inlet duct 9 of the common vessel 4, is connected to a heat consuming (or distributing) unit (not shown).

To form a cooling system 2, the straight tube sections 6' of the heating system are each surrounded, with a radial clearance, by a tubular cooling jacket 2', The cooling jackets 2' are connected together at their upper and lower ends by transversely extending tube sections 2''. In addition, there are provided for the cooling system a coolant inlet 11 and a coolant outlet 12.

The illustrated installation may be used or operated either as a heating installation alone or only as a cooling installation, or alternatively as a combined heating and cooling installation or in another manner as will be described hereinafter.

In operation as a heating installation, the heat-carrying medium W, which is caused to flow in the direction of the arrows 9' and 10' under predetermined, regulated flow conditions through the tube 6 of the heating system and which is taken up from the common vessel 4 by the circulating pump 1 and fed thereby to the tube 6, is heated to the desired temperature by the electrical heating elements 3 and is fed through the outlet duct 10 to the heat-consuming unit (not shown), through which it circulates and then returns to the common vessel 4, the circulating pump 1, the heating system, and so on.

When the installation is to be employed solely for cooling, coolant is supplied through the coolant inlet 11 and is passed through the cooling jackets 2' in the direction of the arrows 11' and 12' until the heat-carrying medium W flowing through the tubes 6 attains the desired temperature.

When the installation is operated as a combined heating and cooling installation, the heat-carrying medium W is circulated in the direction of the arrows 9' and 10' through the heating system and, at the same time, coolant is fed through the cooling jackets 2' in the direction of the arrows 11' and 12', i.e. in counter-current to the heat-carrying medium W. The heat-carrying medium may be maintained at the desired temperature by means of a regulator (not shown) which regulates the heat dissipated by the heating elements 3, and if necessary undesired thermal energy may be dissipated through the cooling jackets 2' by the use of the coolant.

The installation may be used as a heating installation having two stages. In this case, a heating medium, for example hot water or steam, is passed through the cooling jackets 2' surrounding the tube 6 of the heating system for the heating in a first stage, so that the heat-carrying medium, for example oil, is preheated, whereafter the heat-carrying medium is further heated in a second stage as it flows through the tube 6 of the heating system by means of the heating elements 3 which are heated by electrical energy.

The installation according to the invention may furthermore be used and operated as a continuous heat exchanger. For this purpose, heat is extracted from the medium W which is present in the common vessel 4, and which is continuously pumped thereto, by the introduction of coolant into the cooling jackets 2', or heat is supplied to the medium by the passage of hot water or steam through the cooling jackets, or by heating of the medium by means of the electrical heating elements 3. In this way, the installation according to the invention may also be employed as a temperature-adjusting unit for liquids of all kinds, which may be heated and/or cooled in the common vessel 4. After completion of a temperature-adjusting operation, the liquid can be pumped away, or further pumped and then returned to the common vessel 4 for carrying out a discontinuous temperature-adjusting operation.

In addition, it is possible for the illustrated installation according to the invention to be used as an immersion-type temperature-adjusting and pumping unit for stirring and mixing containers if the common vessel 4 is formed by such a stirring and mixing container. Also, heat can be supplied, for example, to a mass to be melted which is present in the common vessel in a manner hereinbefore described and the molten mass may be further conveyed in a liquefied condition under defined conditions of flow. For this purpose, it is merely necessary for the circulating pump 1 and the tube of the heating system to be constructed, for example, as an immersion unit adapted to be immersed in a granular or pulverous mass.

It is furthermore possible for the illustrated installation to be used, with or without the cooling system, as a pumping and temperature-adjusting intermediate station for media to be heated. The medium, which is passed through the common vessel 4 by way of the inlet and outlet ducts 9 and 10 respectively, is in this case heated in the above-described manner and pumped further at the predetermined temperature.

Also, a medium situated in the common vessel 4 may be brought into the vaporous phase by means of the heating system and the installation according to the invention may thus serve as a steam or vapour generator. Likewise, the installation may be used as a warm water and hot water supply system, and finally also as a storage-heat supply system if the generated heat is drawn off to a heat storage means.

I claim:

1. A heat transfer arrangement for heating and cooling a liquid heat carrier medium comprising: a tank for receiving a quantity of liquid heat carrier medium, said tank having an intake and outlet; a plurality of straight parallel pipes within said tank; said pipes being connected in series; said series-connected pipes forming a flow path for said heat carrier medium; heating means within each of said straight pipes in spaced relation to the inner surface thereof for supplying heat to said heat carrier medium; cooling means including a cooling jacket substantially surrounding each of said straight pipes for circulating a cooling medium in heat exchange relation with the exterior surface of the pipe; circulating pump means having an inlet and a pressure outlet; said series-connected pipes having an intake end connected to said pressure outlet of said pump means; said tank outlet being connected to the other end of said series-connected pipes, said other end being an outlet end of said series-connected pipes; said pump means comprising an immersion pump and being located together with said series-connected pipes in said tank; said pump means inlet being located in a lower portion of said tank for receiving said liquid heat carrier medium therefrom; said tank being partially filled with said heat storage medium to a level above said pump means inlet and serving as a collector of heat carrier medium entering said tank through said intake of said tank; said tank also serving as an expansion tank for pressure differences arising in said pipes; said heat carrier medium being delivered to a heat distributing unit through said outlet of said tank; said heat carrier medium being returned to said tank from the heat distributing unit through said intake of said tank, the arrangement of said heating means within and said cooling jacket around each of said straight pipes being such that said heat carrier medium and said cooling medium flow in separate flow-through spaces, said flow-through spaces being shaped for predetermined flow conditions so that said heat carrier medium flows at substantially uniform speed in a relatively thin layer on walls of said pipes for predetermined transfer of heat from or to said heat carrier medium.

2. A heat transfer arrangement as defined in claim 1 wherein said heating means comprises rod-shaped electrical heating elements located relative to said pipes for providing a uniform free flow cross section for said heat carrier medium between said heating elements and internal walls of said pipes.

3. A heat transfer arrangement as defind in claim 1 wherein said cooling jackets have a cooling medium intake extending into said tank; said cooling jackets have a cooling medium outlet; and said cooling means including coolant supply means with circulating lines connected to said cooling medium intake and said cooling medium outlet.

4. A heat transfer arrangement as defined in claim 1 wherein said series-connected pipes together with said pump means comprise a composite unit with only one junction point located between said pipes and said circulating pump means, said composite unit being immersible in said tank, said junction point having connection flanges.

5. A heat transfer arrangement as defind in claim 1 wherein said heating means comprises rod-shaped electrical heating elements arranged in said pipes for providing a uniform free flow cross section for said heat carrier medium between said heating elements and internal walls of said pipes; said cooling jackets having a cooling medium intake and a cooling medium outlet, said cooling medium intake extending into said tank; said cooling means including coolant supply means having circulating lines connected to said cooling medium intake and said cooling medium outlet; said series-connected pipes together with said pump means comprising a composite unit with only one junction point between said pipes and said pump means, said composite unit being immersible in said tank, said junction point having connection flanges.

* * * * *